United States Patent [19]

Denhart

[11] 4,344,114

[45] Aug. 10, 1982

[54] TAMPER-PROOF SECURITY DEVICE FOR SURFACE MOUNTED ELECTRICAL OUTLETS AND THE LIKE

[76] Inventor: Norbert J. Denhart, 2845 Westonridge Dr., Cincinnati, Ohio 45239

[21] Appl. No.: 164,791

[22] Filed: Jun. 30, 1980

Related U.S. Application Data

[63] Continuation of Ser. No. 901,302, May 1, 1978, abandoned.

[51] Int. Cl.[3] ..... F21S 1/02

[52] U.S. Cl. ..... 362/147; 362/145; 362/368; 362/374; 362/376; 362/404

[58] Field of Search ..... 362/147, 376, 145, 368, 362/374, 404

[56] References Cited

U.S. PATENT DOCUMENTS 4,001,778 1/1977 Ross ..... 362/376

*Primary Examiner*—Stephen J. Lechert, Jr.

*Attorney, Agent, or Firm*—Kinney and Schenk

[57] ABSTRACT

A see-through housing fabricated from tamper-proof material is pivotally mounted relative to the undersurface of a flat mounting plate the dimensions of which are such as to exceed the spacing between pairs of adjacent joists or studs in the walls or ceiling of a building, said plate being anchored to said joists or studs by means of fastener elements which are, preferably, thereafter rendered irremovable. An opening is provided within the plate for providing access to an electrical outlet or the like which projects through said opening, said outlet being visible when enclosed within the housing.

3 Claims, 3 Drawing Figures

TAMPER-PROOF SECURITY DEVICE FOR SURFACE MOUNTED ELECTRICAL OUTLETS AND THE LIKE

This is a continuation, of application Ser. No. 901,302, filed May 1, 1978, now abandoned.

BACKGROUND OF THE INVENTION

1. Field of the Invention

The invention relates to a tamper-proof security device in the form of a housing, fabricated from a see-through material, which is hingedly secured to an enlarged mounting plate which is in turn secured to a ceiling or wall surface by fasteners which extend into and engage each of a pair of laterally spaced adjacent joists or studs. The housing is movable between open and closed relationship with respect to an electrical outlet which projects through an opening in the mounting plate. When the housing is in a closed position it is adapted to be locked for thereby effectively preventing the unauthorized access to the electrical outlet.

2. Description of the Prior Art

U.S. Pat. No. 4,001,778 of E. T. Ross discloses a flasher lamp/protective container assembly which includes an enclosure 10 of mesh construction having an open end to facilitate the introduction of a flasher lamp into the interior of the enclosure, said enclosure including means for securing one wall thereof to the horizontal member 14 of a barricade 12 for providing a theft-proof mounting of the container of such a nature as to protect the flasher lamp against theft and/or physical damage arising from vandalism.

U.S. Pat. No. 3,917,941 of T. Trevithick discloses a 2-piece lamp guard fabricated from flexible material wherein one piece is adapted to engage the neck 7 of a lamp socket and wherein the other portion is adapted to threadably engage the lower edge of said first portion for thereby completely housing a light bulb mounted in said socket.

U.S. Pat. No. 937,503 of S. Asch discloses a locking device in the form of a pyramidal shaped cover, for the ropes of an awning, which is pivotally secured to a base plate which is attached by screws to a wall. The cover is movable between an unlocked, open position and a locked, closed position housing the awning ropes.

The aforesaid three patents represent the most pertinent and/or relevant art known to applicant.

SUMMARY OF THE INVENTION

The invention is directed to simple, yet highly effective, means for preventing the unauthorized access to and/or the theft and/or physical vandalization of lighting fixtures and in particular the theft of electricity from electrical outlets, such as by way of example, are located in the public areas, such as halls, entrance ways, stairwells, storage areas, and the like of buildings and in particular apartment buildings occupied by low-income tenants.

It is rather widespread practice in low-income housing projects for the tenants to literally steal electric power from the landlord by removing the light bulbs from electrical outlets and of then plugging in an extension cord for obtaining free electrical energy with which to operate lights and other appliances in their apartments. It is likewise a commonplace occurrence for light bulbs to be vandalized, broken, or stolen from the electrical outlets in the public areas of buildings thereby rendering the operators and/or owners subject to fines for violating the laws and/or ordinances which require that all public areas of buildings be adequately illuminated at all times.

It is almost beyond belief as to the industry and ingenuity which unscrupulous members of the public will resort to in an effort to damage and render useless light fixtures; or steal the bulbs therefrom; or use the electric outlets as a source of unauthorized electric power.

The lighting fixtures and light-weight cage-like housings which have heretofore been associated with such electrical outlets are wholly ineffective for preventing removal of bulbs or damage to the lighting fixtures in public access areas.

The subject invention is directed to means which have proven highly successful in combatting and preventing the fruition of damage to and/or theft of light bulbs and/or theft of electric power from such electrical outlets.

PREFERRED EMBODIMENT OF THE INVENTION

Figure 1:
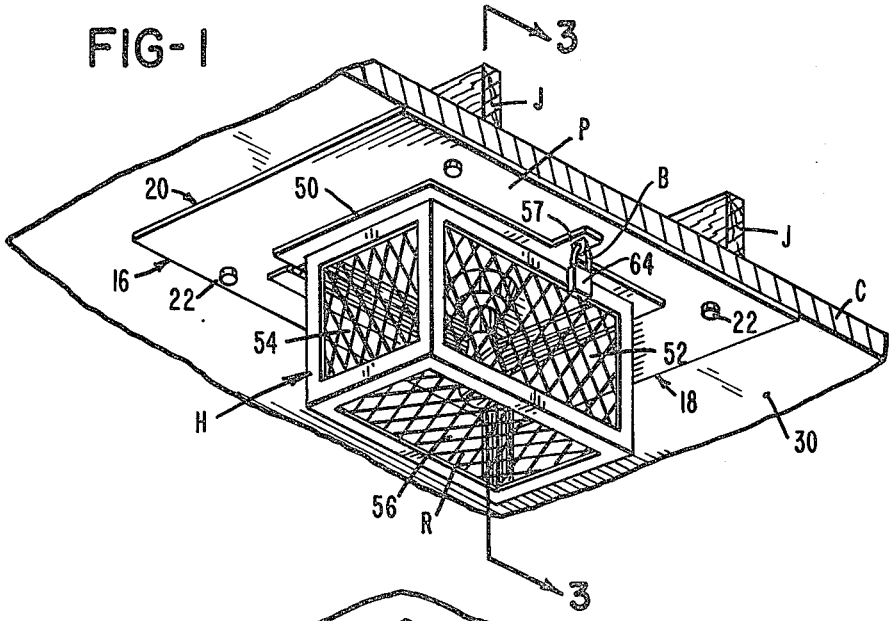
FIG. 1 is a perspective view partly in section illustrating the protective device of the subject invention completely installed with the cover in a closed position for affording tamper-proof protection to the ceiling-mounted light fixture and the light bulb associated therewith.
Figure 2:
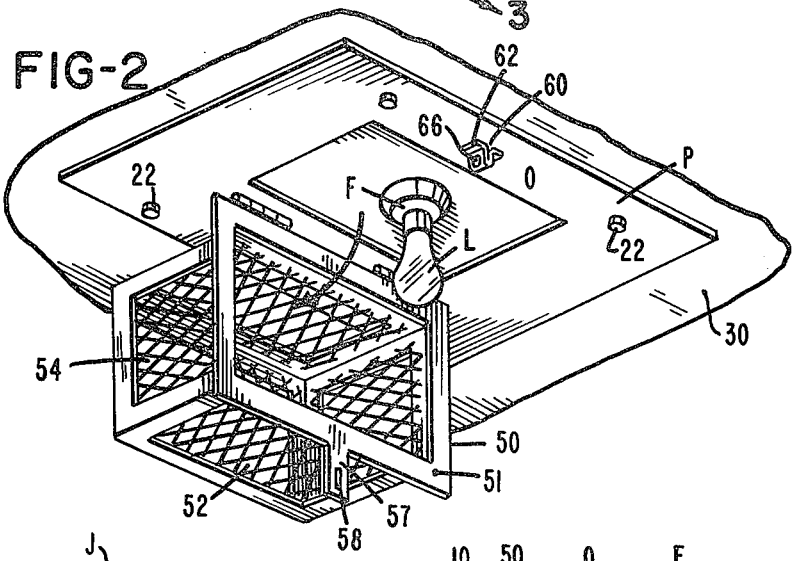
FIG. 2 is a view similar to FIG. 1 illustrating the protective cover in a lowered or fully open position for affording access of authorized personnel to the light fixture or light bulb thereof.

With particular reference to FIG. 1 the letters J designate generally a pair of adjacent laterally spaced studs or joists from which a conventional ceiling C is supported.

A flat mounting plate P fabricated from metal or other rigid material characterized by its ability to withstand distortion, is characterized by upper and lower flat coplanar, axial surfaces 10 and 12 which are defined by laterally spaced side edges 14 and 16 and a pair of laterally spaced end edges 18 and 20 wherein the spacing between end edges 18 and 20 are of a dimension which is at least equal to, and preferably exceeds by several inches, the spacing between the outer side edges of a pair of laterally spaced adjacent joists or studs J.

Plate P is provided with several through apertures for the reception of lag bolts, or the like, 22, the threaded shanks of which are sufficiently long to effect a substantial threaded engagement with the interior of joists J for securely and fixedly mounting plate P to and against lower surface 30 of ceiling C, or to the vertical surface of a wall.

If desired, after being fully inserted the heads of the lag bolts may be permanently fixed against removal by means of a spot weld, or by distorting or altering the head so as to preclude its being engaged by a conventional wrench, screw driver, or other tool.

A light fixture housing H is hingedly mounted as at 40 to surface 12 of plate P, wherein the housing includes upper, lower, side and end areas which are defined by a substantially rigid framework. The numeral 50 designates a rigid, flat, peripheral top defining frame member surface 51 of which is adapted and dimensioned to abut against those portions of surface 12 of the mounting plate P which circumscribe opening O of the plate when the housing is closed.

The side, end, and bottom areas 52, 54, and 56 are defined by rigid corner-defining lengths of angle iron suitably formed or interconnected to define a unitary rigid framework, the upper end of which is defined by peripheral member 50.

See-through panels fabricated from any suitable material which is characterized by its inherent resistance to breakage, distortion, and ease of cutting, are rigidly fastened or anchored to the framework for thereby enclosing the side, end, and bottom areas 52, 54, and 56 of the housing. The panels may comprise sheets of transparent material such as tempered glass, plastic, or the like, or the panels may be fabricated from an open-mesh metal or plastic R. The essential characteristic of the material from which the panels are fabricated is, as noted, its inherent resistance to breakage, distortion, or cutting, whereby to provide damage-proof panels through which the electrical outlet, fixture F and/or lamp L may be observed, and through which the light rays from lamp L may freely pass for providing the desired level of illumination to the area being serviced by the particular electrical outlet being protected by the subject device.

In passing it should be noted that the electrical oulets to which fixture F are customarily secured relative to and carried by a mounting strap (not illustrated) which spans and is anchored to the same pair of laterally spaced support members J to which plate P is secured.

Frame 50 includes a tongue 57 formed integrally therewith having a slot 58 therein to receive the outwardly projecting legs 60 of securement member 62 which is rigidly affixed, such as by means of welding or the like, to surface 12 of plate P.

Figure 3:
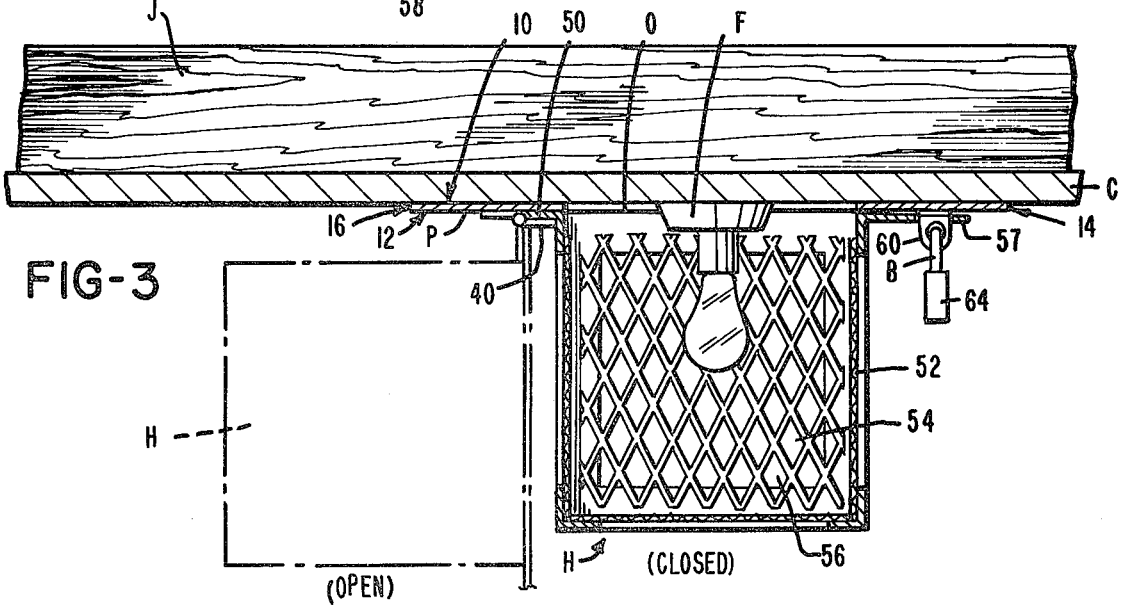
FIG. 3 is a side view taken on line 3—3 of FIG. 1.

The housing, as best illustrated in FIGS. 1 and 3, is adapted to be locked in closed position by means of the hasp B of a conventional lock 64 being introduced through opening 66 in member 62 for thereby securely, though releasably, fastening the housing in closed condition for thereby effectively preventing any unauthorized access to the enclosed electrical outlet, light fixture F and/or lamp L.

By fixedly anchoring the rigid plate P relative to the studs or joists J of a ceiling or a wall, the likelihood of removal, dislodgment, or distortion of the plate to gain access to the electrical outlet and items associated therewith is, for all practical purposes, so remote as to be non-existent.

The structural details of the cover member H, and the manner in which an appreciable flat area of its surface 51 abuts against surface 12 of the plate when the cover is closed, as in FIG. 1, renders the likelihood of prying or distorting the cover from its closed engagement with the plate so remote as to present no problem to the owner, operator, or manager of a building.

Uniformly satisfactory results have been obtained in those instances in which plate P is fabricated from flat metal plate ⅛" thick; the frame members 50, 52, and 54 of the cover were fabricated from 13 gauge metal flat stock and L channels welded to provide a unitary, rigid structure, and wherein the open mesh material R is 13 gauge suitably anchored by means of welding or adhesives to the frame members of the cover. The plates of the hinge are likewise permanently secured to portions of surface 12 of the plate and to that surface of frame member 50 which is opposite surface 51.

Use of the subject device has completely eliminated the breakage and theft of light bulbs and the theft of electrical energy from all of those electrical outlets which have been protected by the device.

I claim:

1. In combination with a building structure including a pair of spaced support members, a tamper-proof security device comprising:

(a) a flat mounting plate spanning a pair of spaced support members, the mounting plate having a central opening therethrough dimensioned to accommodate an electrical fixture which is secured relative to and carried by said spaced support members and a plurality of peripheral aperatures spaced to register with the pair of spaced support members;

(b) a plurality of anchoring elements extending through the peripheral aperatures into support members for securely positioning the plate relative to the support members, said anchoring elements being secured relative to said mounting plate against removal or withdrawal from said spaced support members;

(c) a building surface interposed between said support members and said mounting plate;

(d) a housing defined by upper, lower, side and end areas, the periphery of each of which is defined by a framework of material which is substantially cut-resistant and distortion free and see-through panels of material which is characterized by it's inherent resistance to breakage, distortion, and ease of cutting secured to and carried by said framework for defining an enclosed area, the interior of which is clearly visible, said housing including an upper open end and a flat, peripheral lip which projects outwardly of and circumscribes the upper open end of said housing, a surface of said lip being adapted to abut against those portions of a surface of the mounting plate which circumscribes the central opening therein during those periods of time when the housing is disposed in a closed position for procluding the unauthorized or malicious insertion of a pry-tool between the adjacent surfaces of said housing and mounting plate;

(e) means for hingedly securing the housing to the mounting plate to permit pivotal movement of the housing between an open position which allows access to the central opening in the mounting plate and a closed position in which access to the central opening is blocked; and (f) means for securely, though releasably, securing the housing in the closed position for preventing unauthorized access to the interior of the housing and the opening in the mounting plate.

2. A security device as recited in claim 1 wherein said building surface is a ceiling.

3. A security device as recited in claim 1 wherein said building surface is a wall.

* * * * *